United States Patent [19]

Uetuji et al.

[11] Patent Number: 4,573,879

[45] Date of Patent: Mar. 4, 1986

[54] ROTARY COMPRESSOR

[75] Inventors: Toshio Uetuji, Hirakata; Noriaki Ohkubo, Fujisawa, both of Japan

[73] Assignee: Matsushita Refrigeration Company, Osaka, Japan

[21] Appl. No.: 623,224

[22] Filed: Jun. 21, 1984

[30] Foreign Application Priority Data

Jun. 24, 1983 [JP] Japan ..... 58-114543
Sep. 5, 1983 [JP] Japan ..... 58-163575

[51] Int. Cl.[4] ..... F04B 21/00

[52] U.S. Cl. ..... 417/312; 181/403; 417/902

[58] Field of Search ..... 417/902, 312, 313, 363, 417/540, 542; 62/296; 181/403; 418/63, 270

[56] References Cited

U.S. PATENT DOCUMENTS

| | | | |
|---|---|---|---|
| 2,200,222 | 5/1940 | Tarleton | 417/312 |
| 2,764,342 | 9/1956 | Dills . | |
| 3,252,425 | 5/1966 | Witt | 417/542 |
| 3,459,275 | 8/1969 | Prillwitz et al. . | |
| 3,513,476 | 5/1970 | Monden et al. . | |
| 3,676,021 | 7/1972 | Warner | 417/312 X |
| 4,088,428 | 5/1978 | Bannister et al. . | |

FOREIGN PATENT DOCUMENTS

| | | | |
|---|---|---|---|
| 53766 | 10/1937 | Denmark | 418/63 |
| 188351 | 1/1957 | Fed. Rep. of Germany | 62/296 |
| 913030 | 12/1962 | United Kingdom | 62/296 |

*Primary Examiner*—Edward K. Look
*Attorney, Agent, or Firm*—Wenderoth, Lind & Ponack

[57] ABSTRACT

A rotary compressor for refrigerating apparatuses, including a motor unit, a compressor mechanism section including a cylinder, rotary piston in the cylinder and a bearing between the motor unit and the cylinder, and a discharge muffler. The discharge muffler is formed of a diaphragm and a discharge cover placed over a surface of the bearing opposite the motor unit, the surface of the bearing covered by the diaphragm having a concavity therein housing a valve leading to the cylinder. The diaphragm has a permanently open diaphragm hole for permitting the pressurized gas therein to flow into a discharge chamber defined between the diaphragm and the discharge cover, whereby the portion of the concavity not filled by the valve and the diaphragm define a muffler for muffling sounds of the compressor.

11 Claims, 14 Drawing Figures

ROTARY COMPRESSOR

BACKGROUND OF THE INVENTION

The present invention relates to a rotary compressor for use in refrigerators, air conditioners, heat pumps, etc., and is particularly intended to achieve improvement in its muffler.

Heretofore, in a commonly used muffler in such rotary compressors, the discharge muffler is formed by forming a concavity beneath the lower bearing and covering this cavity with a flat plate, as defined by R. L. Dills' U.S. Pat. No. 2,764,342 and J. E. Bannister's U.S. Pat. No. 4,088,428. With these mufflers of the two U.S. patents, vibration sounds are transmitted through the plate and emitted into the closed case, thus still producing loud noise. They were thus imperfect as mufflers. Furthermore, a rotary compressor of a structure in which the discharge chamber is formed by providing a cup shape discharge cover on one side of the bearing which receives an end of the crankshaft and, further, a cylindrical discharge muffler is provided on this discharge chamber is known. Through employment of such a structure, the shortcomings in the aforementioned two U.S. patents are eliminated for enhanced muffling effect.

However, as a result of the cylindrical discharge muffler being separately installed within the closed case, the volume of the closed case was increased and this interfered with overall miniaturization. Moreover, the tendency of chattering coming out from the junction between the cylindrical discharge muffler and the discharge chamber remained unsuppressed.

SUMMARY OF THE INVENTION

The present invention designed for overcoming the aforementioned difficulties has as its main object providing a discharge muffler improved in its muffling effect.

Another object is to provide a muffler which enables miniaturization of the closed case.

DETAILED DESCRIPTION OF THE PREFERRED EMBODIMENT

Figure 1:
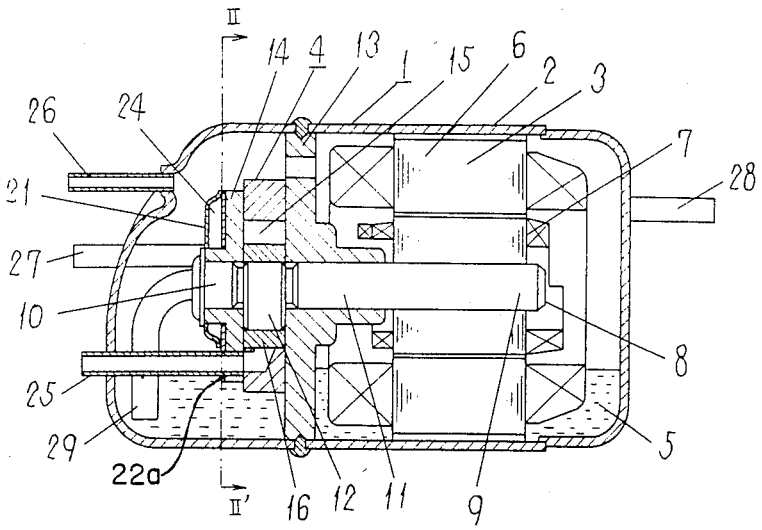
FIG. 1 is a sectional view of an embodiment of this invention.
Figure 2:
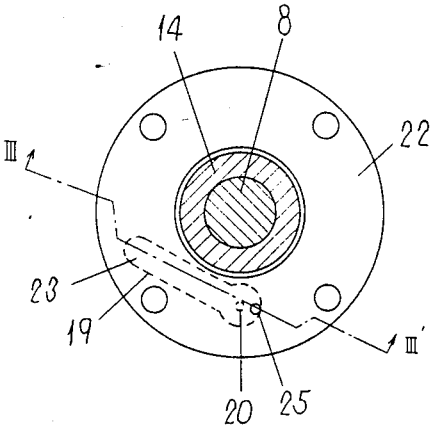
FIG. 2 is a sectional view along a line II—II' of FIG. 1.
Figure 3:
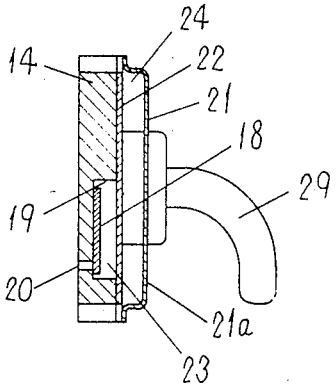
FIG. 3 is a sectional view along a line III—III' of FIG. 2.
Figure 4:
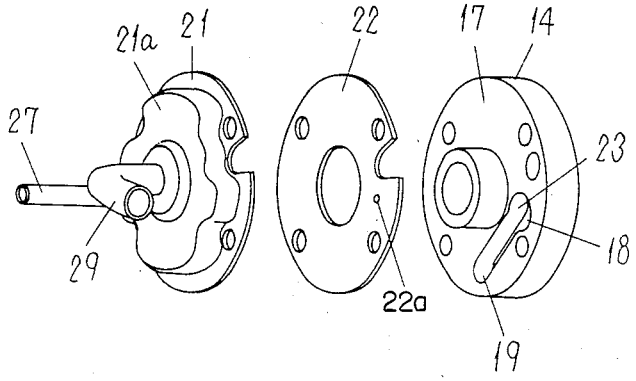
FIG. 4 is a disassembled perspective view of the part shown in FIG. 3.

A first embodiment shown in FIGS. 1–4 is described hereunder: Numeral 1 denotes a compressor, which comprises a closed case 2, motor unit 3 housed in this closed case 2, compressor mechanism section 4 and lubricant 5. The motor unit 3 is composed of a stator 6 shrink-fitted in the closed case and a rotor 7 concentrically inserted inside the stator 6. Numeral 8 designates a crankshaft with its one end part 9 pressed in and fixed to the aforementioned rotor 7. The crankshaft comprises the other end part 10, intermediate part 11 and offset part 12.

The aforementioned compressor mechanism section 4 consists of motor unit side bearing 13 fixed on the inner wall of the closed case 2, a bearing 14 opposite to the motor unit side, and a cylinder 15 sandwiched between the two bearings 13 and 14. The aforementioned motor unit side bearing 13 is supporting the intermediate part 11 of the crankshaft 8, while the bearing 14 opposite to the motor side is supporting the other end part 10. The aforementioned offset part 12 is installed in the cylinder 15 together with a rotary piston 16. On the surface 17 opposite to the cylinder of the aforementioned bearing 14 opposite to the motor unit side, a concavity 19 is provided on a straight line in which a valve 18 is housed and installed. In this concavity 19, a valve hole 20 piercing to the aforementioned cylinder 15 is drilled. Numeral 21 represents a discharge cover equipped with a cup shape protrusion **21*a* and which is screwed (not shown in the drawings) on the surface 17 opposite to the cylinder of the aforementioned bearing 14 opposite to the motor unit side through a flat diaphragm 22. A valve case 23 is formed in conjunction with the aforementioned diaphragm 22 and the concavity 19 of the bearing 14 opposite to the motor unit side. Besides, a discharge chamber 24 is formed by the protrusion 21*a* of the discharge cover 21 and the diaphragm 22. Numeral 22*a* designates a hole bored through the aforementioned diaphragm 22 for communication between the valve case 23 and the discharge chamber 24 nearly in correspondence with the aforementioned valve hole 20. The numeral 25 represents a suction pipe of a cooling system (not shown in the drawings) through hole 22*a* which is connected to the cylinder 15. Numeral 26 designates a discharge pipe of the cooling system, which is connected to the closed case 2. Numeral 27 denotes a precooler discharge pipe mounted on the discharge cover 21 and which communicates with the aforementioned discharge chamber 24. Numeral 28 designates a return pipe for precooler, which communicates with the interior of the closed case 2. Numeral 29 represents and oil pump for supplying lubricant 5 to bearings 13, 14**, etc.

In such a structure, the refrigerant compressed inside the cylinder 15 is discharged through a valve hole 20 into the valve case 23. Further, the refrigerant is discharged into the valve case 23 and is, then, discharged into the closed case 2 through a return pipe 28, after performing the precooling, while passing through a discharge pipe 27 from the discharge chamber 24. Thereafter, it is fed from the closed case 2 into the cooling system through another discharge pipe 26.

Accordingly, the fluctuating pressure component of the refrigerant produced inside the cylinder 15 will be attenuated by the expansion type silencing effect, as the refrigerant is passing through the valve case 23. Besides, because of the hole 22*a* and pipe 25 being located at a position nearly corresponding to the valve hole 20, a strong resonance type silencing effect in the straight line direction of the valve case 23 is achieved and, as a result, the fluctuating pressure component is attenuated.

As above-described, since a resonance type silencing effect, besides the expansion type silencing effect, is obtained, the fluctuating pressure component produced inside the cylinder 15 is well attenuated, without the expansion chamber. Consequently, the fluctuating pressure component of the refrigerant discharged inside the closed case 2 diminishes, resulting in reduced compression noise.

Further, because of the hole 22*a* being located near the valve hole 20, pressure loss is almost zero for improved efficiency of the compressor.

Figure 5:
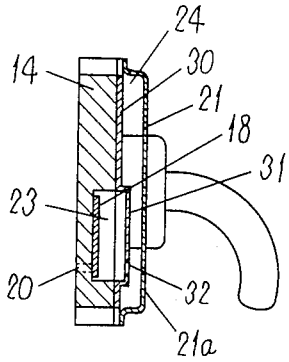
FIG. 5 is a sectional view corresponding to FIG. 3 of a second embodiment.
Figure 6:
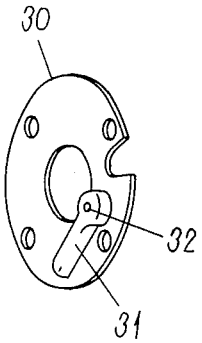
FIG. 6 is a perspective view of the diaphragm shown in FIG. 5.

In the following, a second embodiment is described with reference to FIGS. 1, 5 and 6. In this embodiment, the shape of the diaphragm is characteristic and, therefore, description is made, centering on this diaphragm, with same reference numerals assigned to the same components, as shown in FIGS. 1 through 4. Numeral 30 designates a diaphragm which is interposed between the discharge cover 21 provided with a protrusion 21*a* and the surface 17 opposite to the cylinder of the bearing 14 opposite to the motor unit side, and the discharge cover 21 is screwed (not shown in the drawings) to the bearing 14 opposite to the motor unit side. In the aforementioned diaphragm 30, a cavity 31 is formed, protruding to the inside of the protrusion 21*a* of the discharge cover 21. This cavity 31 is in the same shape as the concavity 19 of the bearing 14 opposite to the motor unit side. The part compartmented by the cavity 31 of the diaphragm 30 and the concavity 19 of the bearing 14 opposite to the motor unit side is used as the valve case and the part compartmented by the protrusion 21*a* of the discharge cover 21 and the diaphragm 30 is used as the discharge chamber 24. Numeral 32 denotes a hole provided in the cavity 31 of the aforementioned diaphragm 30 for communication between the valve case 23 and the discharge chamber 29 oppositely placed near the aforementioned valve hole 20.

In such a structure, the refrigerant compressed inside the cylinder 15 is passed from the valve hole 20 through the valve case 23 and discharged through the hole 32 into the discharge chamber 24. Then, after performing the precooling, while passing from the discharge chamber 24 through the discharge pipe 27, it is discharged into the closed case 2 through the return pipe 28. It is, then, fed from the closed case 2 to the cooling system through another discharge pipe 26. Accordingly, the fluctuating pressure component of the refrigerant produced inside the cylinder 15 is attenuated by the expansion type silencing effect and the resonance type silencing effect, as the refrigerant is passing through the valve case 23. Further, since the capacity of the valve case 23 is increased by the volume of the cavity 31, the effect of attenuation of pressure fluctuation is large and, moreover, the pressure loss that occurs when the refrigerant flows through the valve case diminishes.

Figure 7:
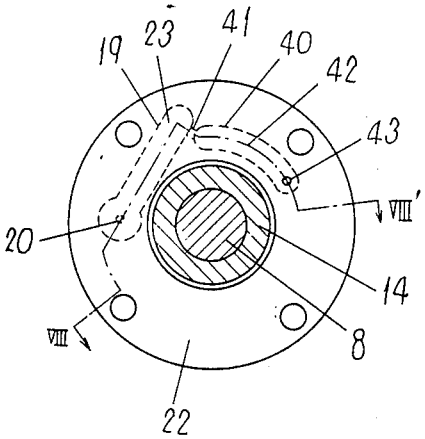
FIG. 7 is a sectional view corresponding to FIG. 2 of a third embodiment.
Figure 8:
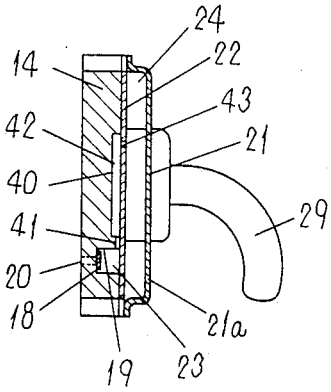
FIG. 8 is a sectional view along a line VIII—VIII' in FIG. 7.
Figure 9:
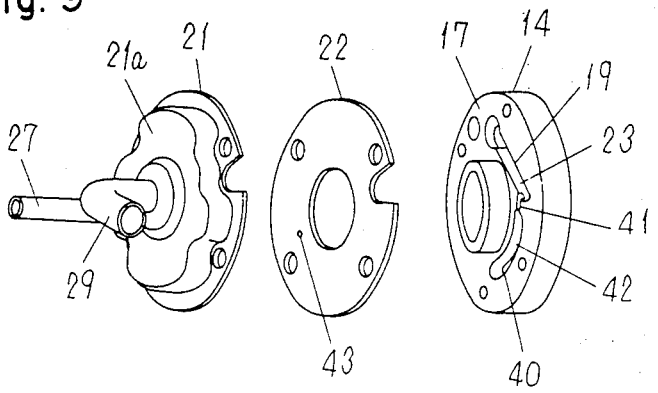
FIG. 9 is a disassembled perspective view of the part shown in FIG. 8.
Figure 10:
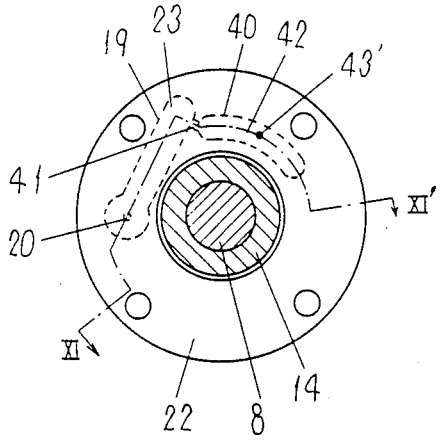
FIG. 10 is a sectional view of the part corresponding to FIG. 2 of a fourth embodiment.
Figure 11:
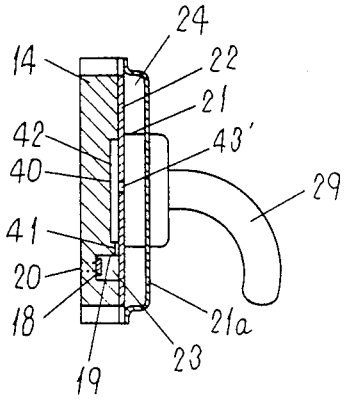
FIG. 11 is a sectional view along a line XI—XI' in FIG. 10.
Figure 12:
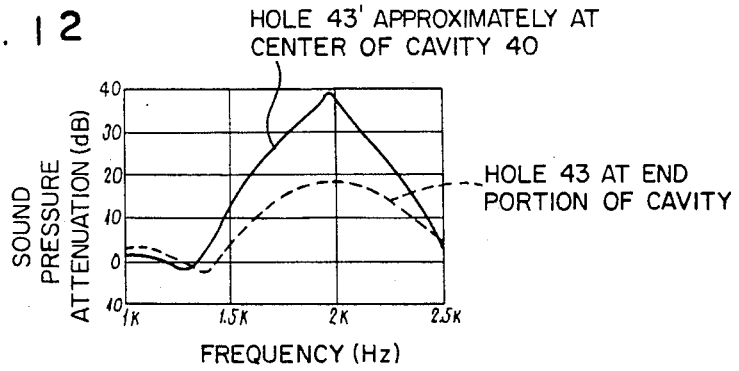
FIG. 12 is a sound pressure attenuation characteristic graph.

In the following, a third embodiment is described with reference to FIGS. 7 through 9. The description is made of the diaphragm and the bearing opposite to the motor unit side, which are particularly different from the previously described embodiments, with the same numerals assigned to the same components which appear on FIGS. 1–4.

Numeral 40 designates a cavity formed on the surface 17 opposite to the cylinder of the bearing 14 opposite to the motor unit side which supports the other end part 10 of the crankshaft 8. This cavity 40 is formed in an arcuate shape with the rotational center axis of the crankshaft 8 as the center, one end of said cavity communicating with the concavity 19 through a small groove 41 and in the concavity 19, a valve hole 20 communicating with the cylinder 15 is formed to house a valve 18 installed therein. A discharge cover 21 equipped with a cup shape protrusion 21*a*, diaphragm 22 and a bearing 14 opposite to the motor unit side are assembled with screws (not shown in the drawings). The space compartmented by this diaphragm 22 in the concavity 19 is used as the valve case 23, and the space compartmented in the cavity 40 is the expansion chamber 42. In addition, the space compartmented by the protrusion 21*a* of discharge cover 21 and the diaphragm 22 is used as the discharge chamber 24. Numeral 43 designates a hole providing communication between the aforementioned expansion chamber 42 and discharge chamber 24, and being located in the aforementioned cavity 40 on the opposite side to the small groove 41.

With this structure, the refrigerant compressed inside the cylinder 15 is discharged through the hole 20 into the valve case 23 formed by the concavity and the diaphragm 22. Further, this refrigerant is ejected into an expansion chamber formed by the cavity 40 and is, then, discharged into the discharge chamber through a small aperture 43.

Thereafter, after performing precooling, while passing from the discharge chamber 24 through the discharge pipe 27, the refrigerant is discharged into the closed case 2 throught the return pipe 28 and is, then, passed along from the closed case 2 through the discharge pipe 26 and fed to the cooling system.

Accordingly, the refrigerant to be compressed inside the cylinder 15 passes through the expansion chamber 42 before being discharged into the closed case 2 through the discharge chamber 24. For this reason, the pulsating pressure component of the refrigerant produced inside the cylinder 15 and in the valve 18 is attenuated by the expansion type silencing effect when the refrigerant passes through the expansion chamber 42; as a result, the pressure pulsation of the refrigerant emitted into the closed case 2 diminishes and the compressor noise decreases.

Furthermore, because the expansion type silencing effect is achieved merely by adding a diaphragm 22, making use of the bearing 14 opposite to the motor side, not only miniaturization of compressors may be realized, but the abnormal noise production due to resonance with a separately placed muffler may be prevented.

In the following a fourth embodiment is described with reference to FIGS. 1 and 10–12. This embodiment differs from the third one shown in FIGS. 7–9 in the position of the hole 43, which is described hereunder:

The hole 43' formed in the diaphragm 22 and which provides communication between the discharge chamber 24 and the expansion chamber 42 is located nearly at the center between the small groove 41 side and the opposite side of the cavity 40. Thus, a large attenuation of pressure pulsation is attained, as shown, for example by the sound pressure attenuation characteristic graph giving the frequency attenuation around 2 kHz. This is because by providing a hole 43' at a position corresponding to the central part of the cavity 40, nearly the same pressure pulsation attenuating effect is achieved as when half of a tail tube is inserted in a nearly cylindrical expansion type muffler.

As hereinabove described, forming a hole 43' provides which communication between the expansion chamber 42 and the discharge chamber 24 provides a very effective pressure pulsation attenuating effect and large compressor noise reducing effect.

Further, merely be adding a diaphragm, making use of the bearing 14 opposite to the motor unit side, the expansion type silencing effect is attained, enabling not only miniaturization of compressors, but also prevention of abnormal noise production due to resonance with a separately placed muffler.

Figure 13:
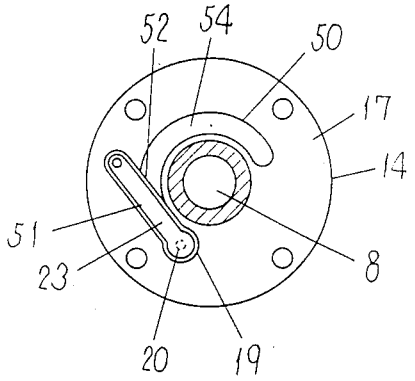
FIG. 13 is a sectional view of the part corresponding to FIG. 2.
Figure 14:
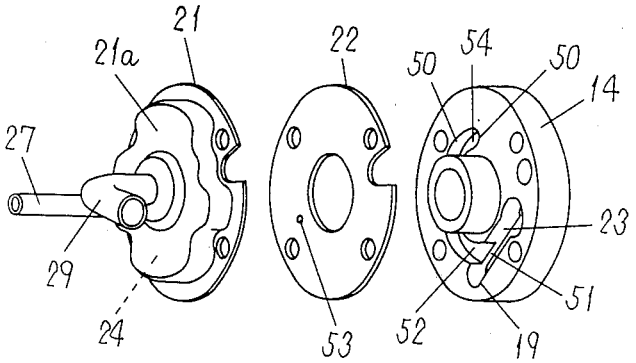
FIG. 14 is a disassembled perspective view of the part shown in FIG. 13.

In the following, a fifth embodiment is described with reference to FIGS. 1, 13 and 14. The explanation is made with the same reference numerals as used in FIGS. 1–4 for identical components.

Numeral 50 denotes a cavity formed on the side of the surface 17 opposite to the cylinder of the bearing 14 opposite to the motor unit side which supports the other end part 10 of the crankshaft 8. An opening part 52 is provided near the central part 51 of the concavity 19 which extends in a straight line formed in the bearing 14 opposite to the motor unit side, said opening part being formed in an arcuate shape, with the rotational axis of the crankshaft 8 as the center. The aforementioned concavity 19 and cavity 50 intersect at the opening part 52 in such a way that their center lines l and l' make a sharp angle.

Numeral 53 denotes a hole formed in the diaphragm 22 which provides communication between the expansion chamber 54 which is compartmented by the aforementioned diaphragm 22 and cavity 50 and the discharge chamber 24 which is compartmented by the diaphragm 22 and the protrusion 21*a* of the discharge cover 21.

With structure, the refrigerant compressed inside the cylinder 15 is discharged through a valve hole 20 into a valve case 23 formed by the concavity 19 and the diaphragm 22. Further, the refrigerant is ejected from the opening part 52 into an expansion chamber 54 formed by cavity 50 and diaphragm 22 and is, then, discharged through hole 53 into discharge chamber 24.

Thereafter, after performing precooling, while passing from the discharge chamber through a discharge pipe 27, the refrigerant is discharged into a closed case 2 through a return pipe 28 and is, then, fed from the closed case 2 through another discharge pipe 26 to the cooling system.

Accordingly, the fluctuating pressure component of the refrigerant produced inside the cylinder 15 is attenuated due to the expansion type attenuation effect, as the refrigerant passes through the valve case 23 and the expansion chamber 54. Besides, since the opening part 52 of the expansion chamber 54 is provided near the central part 51 of the valve case 23, a strong resonance type silencing effect in the straight line direction of the valve case 23 is achieved and, moreover, the fluctuating pressure component is attenuated by the silencing effect by emission at the node position of the aforementioned resonance on the expansion chamber 54 due to the opening being located near the central part 51.

Because of the resonance type silencing effect and the silencing effect due to the emission at the node position of the resonance, in addition to the expansion type silencing effect, being obtained as hereabove described, without throttling the opening 52, the fluctuating pressure component produced inside the cylinder 15 is well attenuated, resulting in decrease in the fluctuating pressure component of the refrigerant emitted into the closed case and reduction of compressor noise.

Furthermore, since no throttled hole exists between the valve case 23 and the expansion chamber 54 and these two compartments intersect at a sharp angle, pressure loss at the opening part 52 is nearly zero, for improved compressor efficiency.

What is claimed is:

1. A rotary compressor, comprising:

a motor unit including a stator and rotor;

a compressor mechanism section including a cylinder having a first side facing said motor unit and a second side opposite said first side, a rotary piston rotationally mounted in said cylinder, a first bearing between said motor unit and said cylinder, and a second bearing at said second side, said first and second bearings respectively covering said first and second sides of said cylinder, said second bearing having a first face facing said cylinder, a second face opposite said first face, a concavity opening into said second face, and a valve hole extending from said concavity to said second side of said cylinder so as to provide communication therebetween;

a motor operated compressor element including a crankshaft interlocking said motor unit and said compressor mechanism section such that said rotary piston is rotationally driven in said cylinder by said motor unit through said crankshaft;

a case enclosing said motor unit, said compressor mechanism section and said element;

a discharge valve element over said valve hole filling part less than all of said concavity;

a diaphragm covering said second face of said bearing, including said concavity; and a discharge cover covering said diaphragm so as to define therebetween a discharge chamber for receiving pressurized gas therein, said diaphragm having a permanently open diaphragm hole therein in the proximity of said valve hole, so as to provide communication therethrough between said concavity and said discharge chamber, whereby the portion of said concavity not filled by said discharge valve element and said diaphragm define muffler means for muffling sounds of said compressor.

2. A rotary compressor as in claim 1 wherein said diaphragm is recessed in a direction away from said concavity over said concavity to define a recess in said diaphragm opposing said concavity, whereby said recess and said concavity define an enlarged volume cavity respectively communicating with said cylinder and said discharge chamber through said valve hole and said diaphragm hole.

3. A rotary compressor as in claim 2, wherein said diaphragm lays directly on said second face in intimate contact therewith so as to define a closed space defined by said concavity and the surface of said diaphragm directly over said concavity.

4. A rotary compressor as in claim 1, wherein said diaphragm lays directly on said second face in intimate contact therewith so as to define a closed space defined by said concavity and the surface of said diaphragm directly over said concavity.

5. A rotary compressor, comprising:

a motor unit including a stator and a rotor;

a compressor mechanism section including a cylinder having a first side facing said motor unit and a second side opposite said first side, a rotary piston rotationally mounted in said cylinder, a first bearing between said motor unit and said cylinder, and a second bearing at said second side, said first and second bearings respectively covering said first and second sides of said cylinder, said second bearing having a first face facing said cylinder, a second face opposite said first face, an expansion chamber and a concavity opening into said second face, said expansion chamber communicating with said concavity, and a valve hole extending from said concavity to said second side of said cylinder so as to provide communication therebetween;

a motor operated compressor element including a crankshaft interlocking said motor unit and said compressor mechanism section such that said rotary piston is rotationally driven in said cylinder by said motor unit through said crankshaft;

a case enclosing said motor unit, said compressor mechanism section and said compressor element;

a discharge valve element over said valve hole;

a diaphragm covering said second face of said bearing, including said expansion chamber; and a discharge cover covering said diaphragm so as to define therebetween a discharge chamber for receiving pressurized gas therein, said diaphragm having a permanently open diaphragm hole therein facing said expansion chamber, so as to provide direct communication therethrough between said expansion chamber and said discharge chamber, whereby said expansion chamber, said concavity, and said diaphragm define muffler means for muffling sounds from said compressor.

6. A rotary compressor as in claim 5, wherein said diaphragm lays directly on said second face in intimate contact therewith so as to define a closed space defined by said expansion chamber, said concavity and the surface of said diaphragm directly over said concavity and said expansion chamber.

7. A rotary compressor as in claim 5, wherein said concavity has side walls which extend parallel to a straight line, said expansion chamber having an arcuate shape and having one end thereof intersecting said side walls at a central portion of said concavity at an acute angle.

8. A rotary compressor according to claim 5, wherein said expansion chamber has a nearly uniform overall sectional shape.

9. A rotary compressor according to claim 5, wherein said diaphragm is provided facing about the central part of said expansion chamber.

10. A rotary compressor according to claim 5, wherein said concavity and said expansion chamber communicate with each other through a small groove.

11. A rotary compressor, comprising:

a motor unit including a stator and a rotor;

a compressor mechanism section including a cylinder having a first side facing said motor unit and a second side opposite said first side, a rotary piston rotationally mounted in said cylinder, a first bearing between said motor unit and said cylinder, and a second bearing at said second side, said first and second bearings respectively covering said first and second sides of said cylinder, said second bearing having a first face facing said cylinder, a second face opposite said first face, a concavity opening into said second face, an expansion chamber communicating with said concavity, and a valve hole extending from said concavity to said second side of said cylinder so as to provide communication therebetween, said concavity having side walls which extend parallel to a straight line, said expansion chamber having an arcuate shape and having one end thereof intersecting said side walls at a central portion of said concavity at an acute angle;

a motor operated compressor element including a crankshaft interlocking said motor unit and said compressor mechanism section such that said rotary piston is rotationally driven in said cylinder by said motor unit through said crankshaft;

a case enclosing said motor unit, said compressor mechanism section and said compressor element;

a discharge valve element over said valve hole;

a diaphragm covering said second face of said bearing, including said expansion chamber; and a discharge cover covering said diaphragm so as to define therebetween a discharge chamber for receiving pressurized gas therein, said diaphragm having a diaphragm hole therein facing said expansion chamber, so as to provide direct communication therethrough between said expansion chamber and said discharge chamber, whereby said expansion chamber, said concavity, and said diaphragm define muffler means for muffling sounds from said compressor.

* * * * *